US007182538B2

(12) United States Patent
Grosso et al.

(10) Patent No.: US 7,182,538 B2
(45) Date of Patent: Feb. 27, 2007

(54) PAINT DISPENSING AND STORAGE KIT

(75) Inventors: Cheryl A. Grosso, 95 Mansion St., Coxsackie, NY (US) 12051; Michael D. Grosso, Jr., 95 Mansion St., Coxsackie, NY (US) 12051; Michael Patterson, Lawrence, KS (US)

(73) Assignees: Cheryl A. Grosso, Coxsackie, NY (US); Michael D. Grosso, Jr., Coxsackie, NY (US)

( * ) Notice: Subject to any disclaimer, the term of this patent is extended or adjusted under 35 U.S.C. 154(b) by 283 days.

(21) Appl. No.: 10/832,630

(22) Filed: Apr. 27, 2004

(65) Prior Publication Data

US 2005/0238413 A1 Oct. 27, 2005

(51) Int. Cl.
*B43K 5/06* (2006.01)

(52) U.S. Cl. ..... 401/176; 401/171

(58) Field of Classification Search ..... 401/171, 401/176, 178, 179, 182, 272, 277, 282, 284
See application file for complete search history.

(56) References Cited

U.S. PATENT DOCUMENTS

| | | | | |
|---|---|---|---|---|
| 3,738,760 | A | 6/1973 | Madeira | |
| 4,522,523 | A | 6/1985 | Vogelsang | |
| 4,619,613 | A * | 10/1986 | Dragan | 433/90 |
| 4,685,820 | A | 8/1987 | Kremer et al. | |
| 5,697,918 | A * | 12/1997 | Fischer et al. | 604/227 |
| D408,148 | S | 4/1999 | Frost et al. | |
| 6,007,335 | A * | 12/1999 | Sheu | 433/90 |
| 6,010,268 | A | 1/2000 | Sereg et al. | |
| 6,053,650 | A | 4/2000 | Bennett et al. | |
| 6,135,659 | A | 10/2000 | Ku | |
| 6,142,868 | A | 11/2000 | Pfanstiehl | |
| 6,202,897 | B1 * | 3/2001 | Martin et al. | 222/386 |
| 6,238,120 | B1 * | 5/2001 | Mark | 401/265 |
| 6,283,663 | B1 | 9/2001 | Russo | |
| 6,536,978 | B2 | 3/2003 | Lowery | |
| 6,749,356 | B1 * | 6/2004 | Mead et al. | 401/289 |
| 7,048,120 | B2 * | 5/2006 | Pond | 206/366 |

* cited by examiner

*Primary Examiner*—Huyen Le
(74) *Attorney, Agent, or Firm*—Dale J. Ream

(57) ABSTRACT

A paint dispensing and storage kit includes a tubular paint dispensing body defining a body chamber and having opposed open and closed ends. A plunger is positioned in the body chamber for movement between inserted and extended configurations. A dispenser tip is operatively connected to the closed end through which paint is drawn into or dispensed from the body chamber upon operation of the plunger. The kit includes a cap removably attachable to the dispenser tip for preventing paint flow therethrough. The kit also includes a plurality of applicator tips for selective attachment to the dispenser tip. The kit further includes a reservoir for storing excess paint, the reservoir being a separate container, a paint cartridge, or integrated with the dispenser body for communicating excess paint therebetween.

16 Claims, 6 Drawing Sheets

PAINT DISPENSING AND STORAGE KIT

BACKGROUND OF THE INVENTION

This invention relates generally to paint applicators and, more particularly, to a paint dispensing and storage kit for use in touching up painted surfaces.

Touching up scraped, scratched, or faded painted surfaces has conventionally required old paint cans to be opened and paint to be brushed onto the desired surface. This is an inconvenient and often messy procedure.

Various devices have been proposed in the art for either storing excess paint until needed or for applying touch-up paint in a more convenient manner. Although assumably effective for their intended purposes, the existing devices do not provide a kit of paint storage and dispensing materials that is convenient and clean to use with little or no preparation or clean up.

Therefore, it is desirable to have a paint dispensing and storage kit that makes paint touch-up jobs quick, convenient, and requires little setup or clean up. Further, it is desirable to have a paint dispensing and storage kit that makes storage of multiple colors or types of paint convenient, organized, and keeps paint fresh for an extended period of time.

SUMMARY OF THE INVENTION

A paint dispensing and storage kit for use in providing touch-up painting to painted surfaces includes a tubular paint body having a closed end and an opposed open end that defines a paint chamber. A plunger is positioned in the paint chamber for longitudinal back and forth movement therein. A dispenser tip extends through the dispenser body through which paint may be drawn into or dispensed from the paint body upon a respective operation of the plunger. Therefore, the dispenser body provides a primary paint storage location, such as for paint that is actively being dispensed through the dispenser tip to a surface to be painted.

The kit further includes a reservoir for storage of excess paint, such as paint to be stored for a longer period of time and to be used at a later time for touch-up of a damaged or worn surface. The reservoir may be in the form of a separate container having an internal funnel from which paint may be drawn into the body chamber to be dispensed. Alternatively, the reservoir may be a paint cartridge received into a base of a reservoir assembly positioned adjacent the paint dispenser body. The paint cartridge includes appropriate valves and a connector channel that interconnects the base with the dispenser tip such that the excess/stored paint in the paint cartridge may be drawn into the paint chamber for use as described above. The kit may also include still another reservoir in which the plunger includes a regulator valve and sealing plate such that paint may be sealed and stored within the body chamber itself without separate storage containers.

Therefore, a general object of this invention is to provide a paint dispensing and storage kit for use in touching up scratched or damaged paint surfaces.

Another object of this invention is to provide a kit, as aforesaid, for storage of small quantities of touch-up paint.

Still another object of this invention is to provide a kit, as aforesaid, having a plurality of applicator tips for applying paint at a desired pattern or style.

Yet another object of this invention is to provide a kit, as aforesaid, in which paint may be transferred between storage and use reservoirs.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

A paint dispensing and storage kit according to the present invention will now be described in detail with reference to FIGS. 1 to 6*d* of the accompanying drawings.

Figures 1A, 1B, 1C:
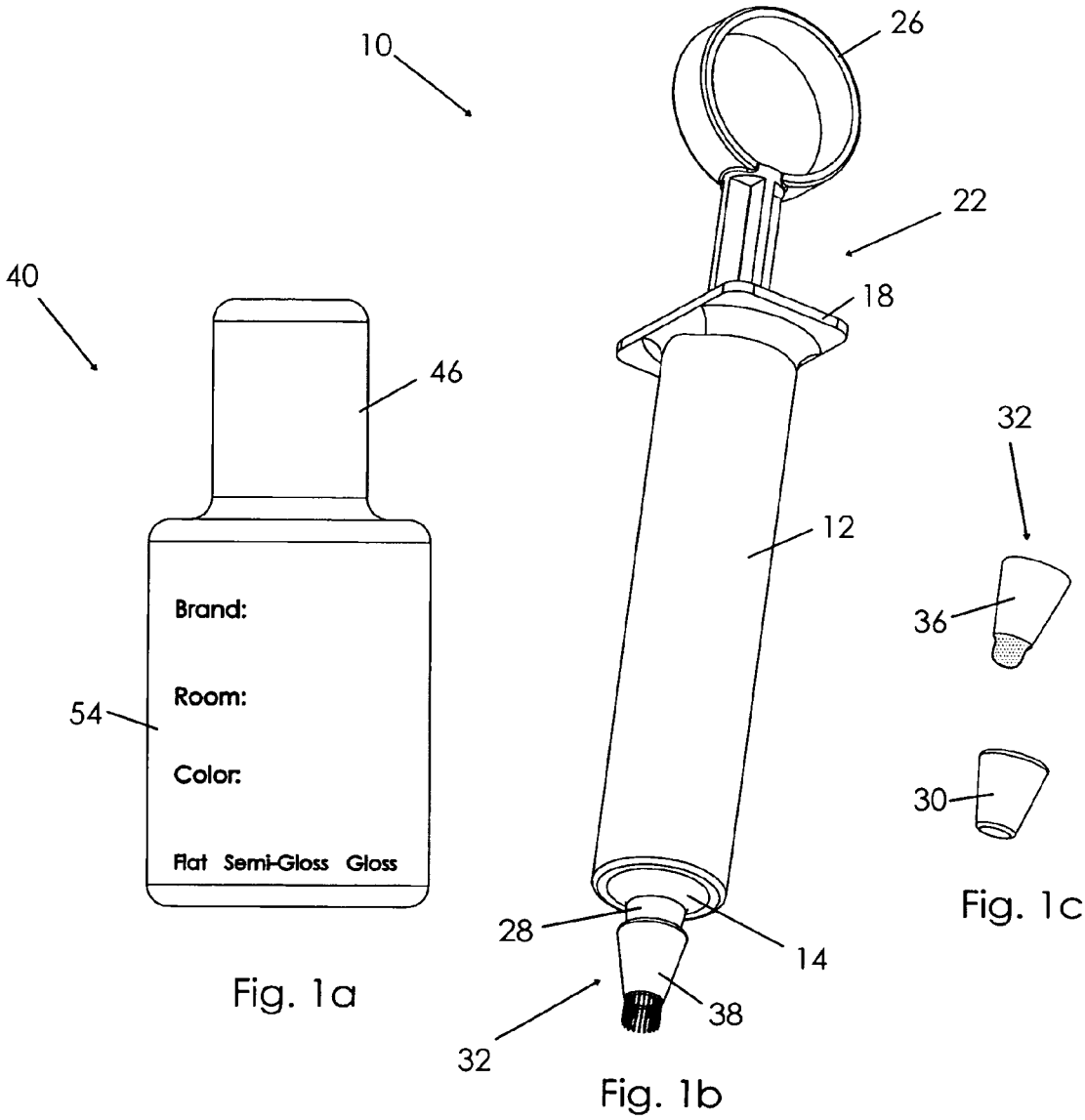
FIG. 1 is a perspective view of a paint dispensing and storage kit according to one embodiment of the present invention.

A paint dispensing and storage kit 10 according to a now preferred embodiment includes a paint dispenser body 12, a separate paint containing reservoir 40, and a plurality of paint applicator tips 32 (FIG. 1). More particularly, the paint dispenser body 12 includes a generally tubular configuration having a closed end 14 and defining an open end opposite the closed end 14. The open ended construction is best seen identified with reference numeral 63 in FIG. 3*a* for another embodiment described later. A pair of oppositely disposed finger tabs 18 are mounted atop the dispenser body 12 adjacent the open end. The tubular paint dispensing body 12 includes a hollow interior space that defines a body chamber for storing a quantity of paint. A body chamber is best illustrated in the embodiment shown in FIG. 3*c* with reference numeral 68.

A plunger 22 is situated in the body chamber for relative back and forth movement therein between an inserted configuration and an extended/withdrawn configuration. The plunger 22 includes a lower end 24 having a diameter substantially the same as an internal diameter of the body chamber and thus provides a seal as to be further described later. The plunger 22 includes a handle member 26 at an end opposite the lower end 24, the handle member 26 being displaced from the open end at the extended configuration. Preferably, the handle member 26 includes a ring-top configuration for improved user control although other handle configurations would also be suitable.

The paint dispenser body 12 includes a dispenser tip 28 extending from the closed end 14 thereof through which paint may be dispensed from or drawn into the body chamber upon a respective movement of the plunger 22. The kit 10 includes a cap 30 selectively attachable or removable from the dispenser tip 28. Paint within the body chamber is prevented from being dispensed when the cap 30 is in place on the dispenser tip 28. The cap 30 and dispenser tip 28 include complementary threads such that the cap 30 may be quickly and conveniently screwed on or off.

Figure 2A:
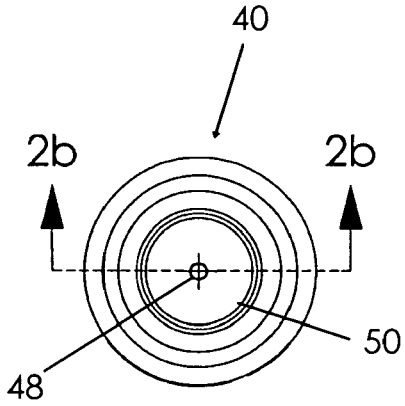
FIG. 2*a* is a top view of the separate paint storage reservoir as in FIG. 1.
Figure 2B:
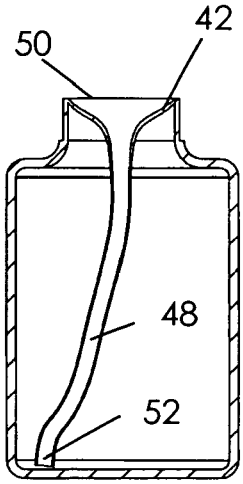
FIG. 2*b* is a sectional view taken along line 2*b*—2*b* of FIG. 2*a;*
Figure 2C:
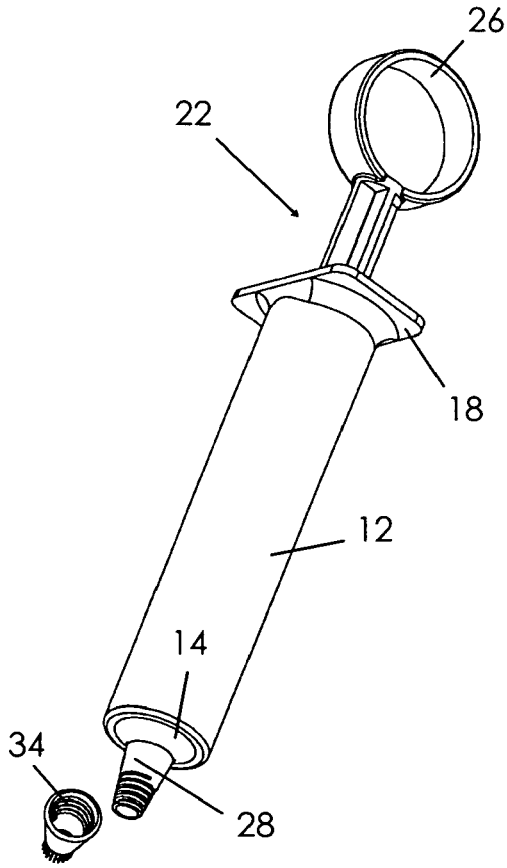
FIG. 2*c* is a perspective view of the paint dispensing body as in FIG. 1 with the applicator tip removed.

The paint dispensing and storage kit 10 further includes a plurality of applicator tips 32 with each tip being threaded 34 as described previously for quick and convenient attachment to the dispenser tip 28 (FIG. 2*c*). The kit 10 preferably includes a sponge tip 36 and a brush tip 38 for use depending on the type of surface paint is being applied to or a desired pattern or texture. Of course, other applicator tips would also be suitable.

The kit 10 further includes a reservoir 40 for storing a quantity of excess paint to be used for touch-up painting as needed. In the now preferred embodiment, the excess paint reservoir 40 is a container separate from the dispenser body 12 and body chamber and defining an open top 42 with a removable cap 46 and defining an interior space (FIGS. 1 and 2*b*). A funnel 48 is mounted within the interior space of the reservoir 40, the funnel including a first open end 50 at the reservoir open top 42 and a second open end 52 adjacent a reservoir bottom 44 (FIG. 2*b*). The first open end 50 includes a configuration complementary to a configuration of the dispenser tip 28 for an airtight mating fluid transfer therebetween. The reservoir 40 includes a label 54 on which the brand and color of the paint being stored as well as the room of one's house that corresponds to the stored paint (FIG. 1). With the reservoir cap 46 in place, the excess paint may be stored and kept fresh for long periods of time until needed.

In use, the cap 30 may be removed and the dispenser tip 28 nested with the open end 50 of the funnel 48. Then, an upward movement of the plunger 22 draws paint from the reservoir 40 through the dispenser tip 28 and into the body chamber. Only enough paint for the job at hand needs to be drawn. The dispenser tip cap 30 may then be replaced if the user is not yet ready to paint. Otherwise, a selected applicator tip may be attached to the dispenser tip 28 and the plunger 22 may be moved toward the inserted configuration so as to dispense an amount of paint onto a surface. It is understood that the lower end 24 of the plunger 22 provides a seal such that paint within the body chamber is forced out through the dispenser tip 28 and does not seep upward toward the open end of the dispenser body 12. Then, the excess paint in the body chamber not used for touch-up may be dispensed back into the reservoir 40. Or, a solvent may be drawn up into the body chamber and then dispensed so as to clean the body chamber.

A paint dispensing and storage kit 60 according to another embodiment of this invention is shown in FIGS. 3*a* to 4*d* and is substantially similar to the kit 10 described previously except as specifically noted below. The kit 60 according to this embodiment also includes a dispenser body 62 with a dispenser tip 66 and a plunger 70. The kit 60 includes a reservoir in the form of a paint cartridge 72 having a generally tubular configuration although other configurations would also work. It is understood that the kit 60 may include multiple paint cartridges, for example, for separately storing different colors or types of paint for later use.

Figure 3B:
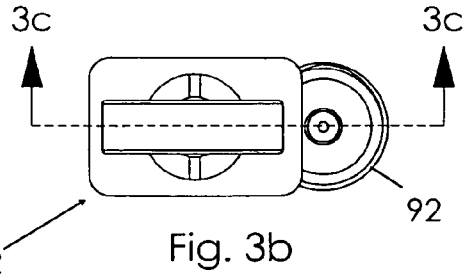
FIG. 3*b* is a top view of the kit as in FIG. 3*a;*
Figure 3A:
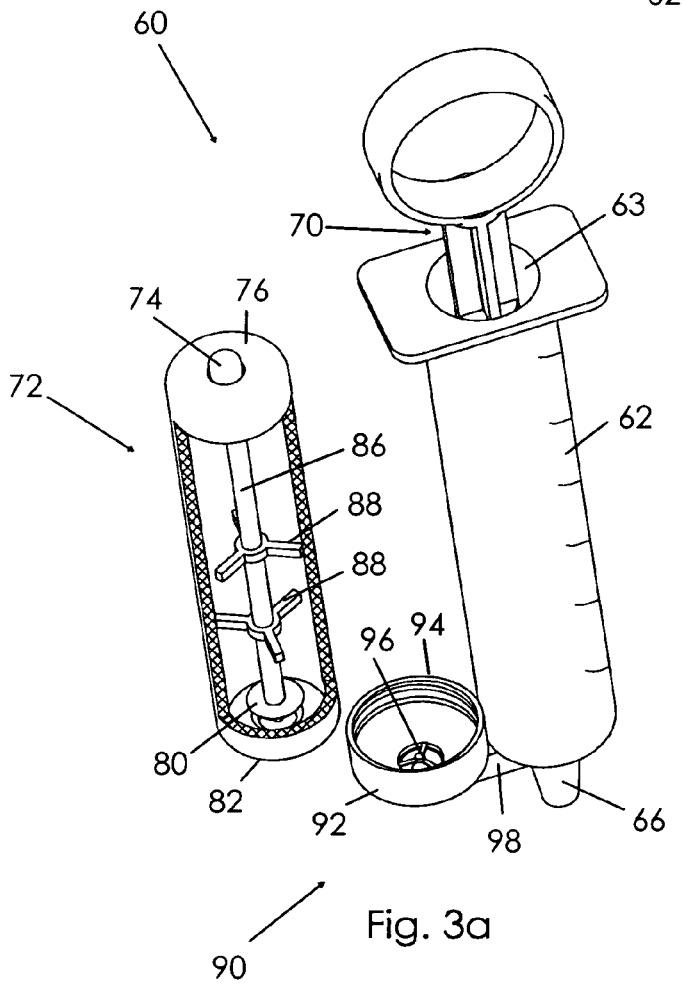
FIG. 3*a* is a perspective view of a paint dispensing and storage kit according to another embodiment of the present invention with a paint cartridge removed from its base and shown with a side wall removed.
Figure 3C:
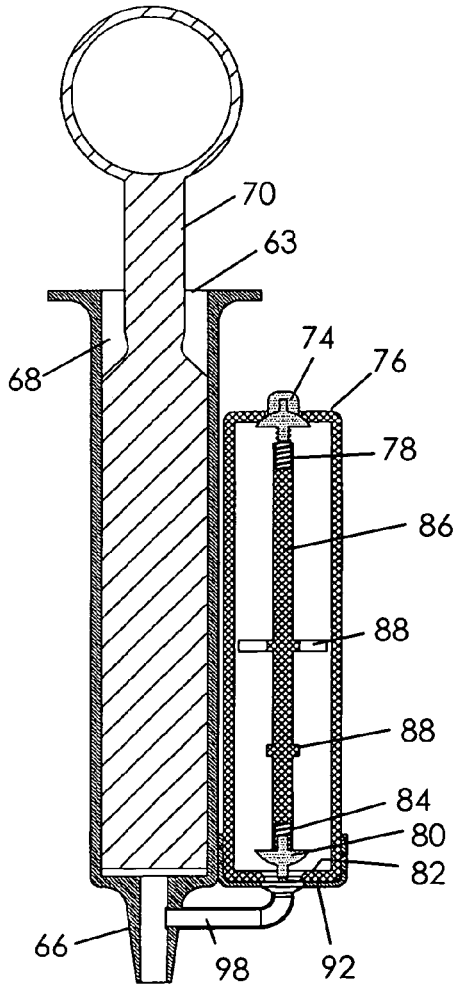
FIG. 3*c* is a sectional view taken along line 3*c*—3*c* of FIG. 3*b;*

As shown in FIG. 3*c*, the paint cartridge 72 includes a push button valve 74 at one end 76 and a transfer valve 80 at an opposed end 82. These valves control the flow of paint into or out of the paint cartridge 72 as to be described below. A shaft 86 is positioned within the paint cartridge 72 and is coupled to the button valve 74 and transfer valve 80 with respective springs 78, 84 for naturally biasing the valves to a closed configuration. The shaft 86 includes at least one agitator arm 88 generally normal to the shaft's longitudinal axis for agitating or mixing paint therein as paint is drawn into or dispensed from the cartridge 72.

A paint cartridge 72 may be partially or completely filled with paint using the dispenser body 62, as to be described in more detail later, and then removably mounted on a reservoir assembly 90 for selective use. More particularly, the reservoir assembly 90 includes a base 92, the paint cartridge 72, and a connector channel 98 connecting the base 92 with the dispenser tip 66 of the dispenser body 62. Preferably, the connector channel 98 is a rigid conduit for communicating a stream of paint from the paint cartridge 72 to the dispenser tip 66 and into the body chamber 68 of the dispenser body 62. The base 92 includes a configuration for releasably receiving and supporting the paint cartridge 72 therein, such as with mating threads 94 (FIG. 3*a*), snap-fit or pressure fit configurations, or other suitable attachment means. The base 92 includes a stem 96 for mating with and actuating the transfer valve 80 of the paint cartridge 72 when the cartridge 72 is mounted in the base 92. It is understood, however, that it would be possible to interconnect the cartridge directly to the connector channel 98 if a base 92 was not included.

Figures 4A, 4B, 4C, 4D:
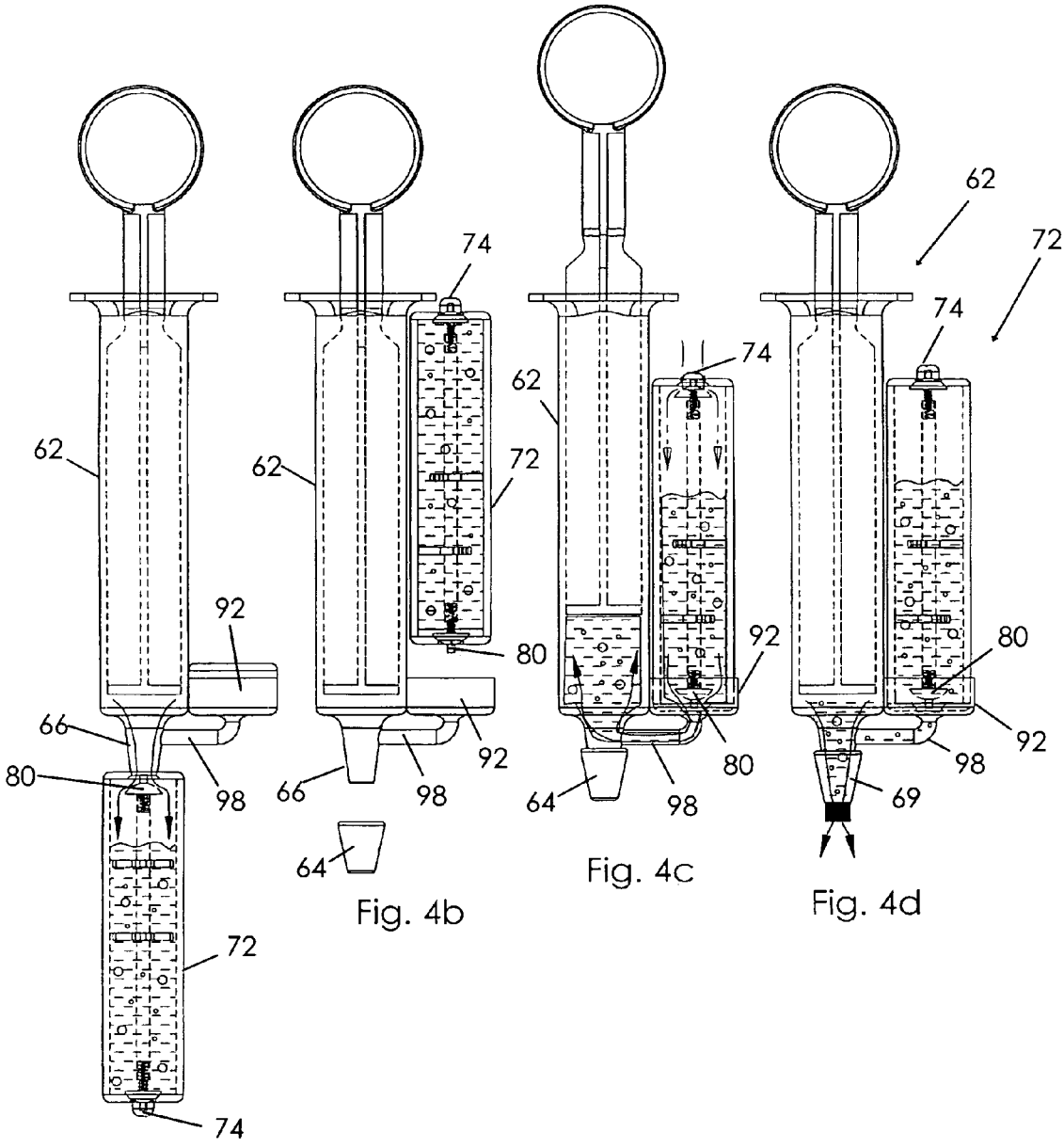
FIGS. 4*a*–4*d* illustrate operation of the kit as in FIG. 3*a;*
Figure 5A:
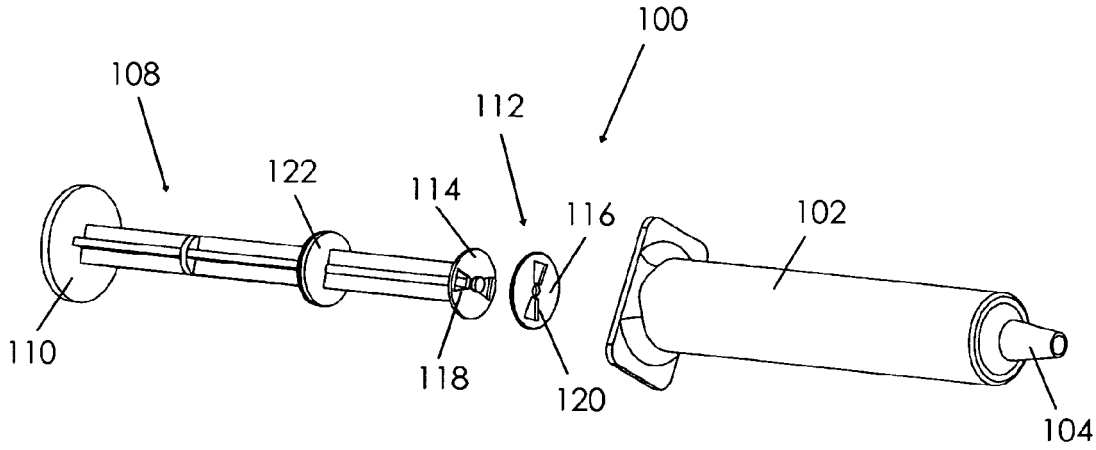
FIG. 5*a* is an exploded view of a paint dispensing and storage kit according to yet another embodiment of the present invention.
Figure 5B:
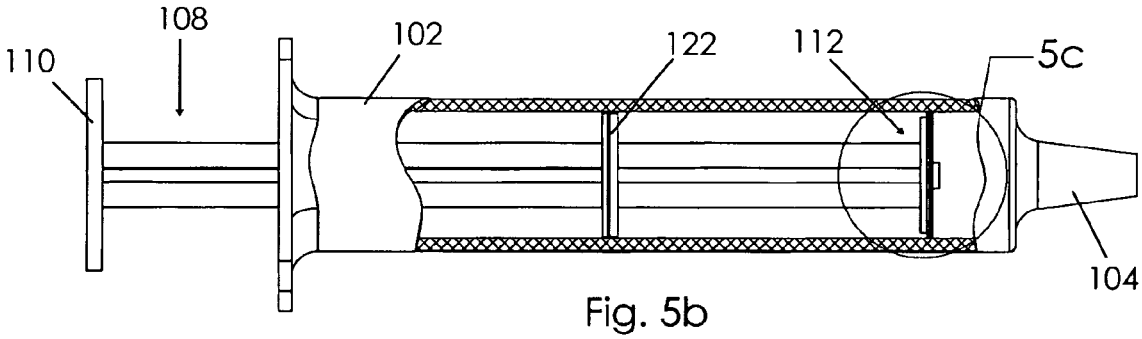
FIG. 5*b* is side view of the kit as in FIG. 5*a* with a side wall of a paint dispenser body being partially removed to view components therein.
Figure 5C:
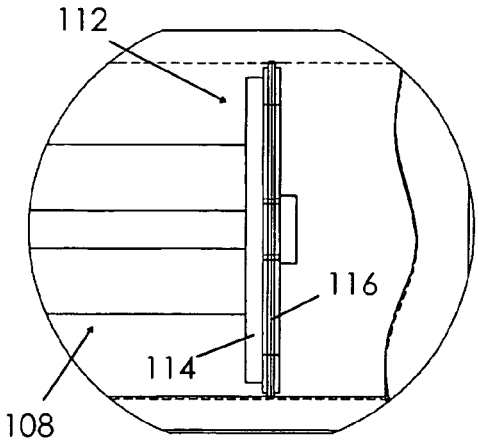
FIG. 5*c* is an enlarged view of a regulator valve as in FIG. 5*b;*

A preferred usage of this embodiment of the kit 60 described immediately above will be described with specific reference to FIGS. 4*a* to 4*d* of the drawings. With cap 64 removed from the dispenser tip 66, the dispenser tip 66 may be coupled with the transfer valve 80 (FIG. 4*a*). Paint from the body chamber 68 may then be dispensed into the cartridge 72 by operation of the plunger 70 to the inserted configuration. The paint cartridge 72 may then be stored for later use or mounted in the base 92 for immediate use (FIG. 4*b*). The cap 64 may be coupled to the dispenser tip 66 so as to prevent any paint from being inadvertently dispensed therefrom. Paint from the cartridge 72 may then be transferred through the connector channel 98 and into the body chamber 68 by depressing the button valve to allow an inflow of air and by urging the plunger 70 to an extended configuration (FIG. 4*c*). In other words, paint is drawn from the paint cartridge 72 into the body chamber 68 and the paint in the paint cartridge 72 is replaced by a volume of air. Finally, paint may be dispensed from the body chamber 68 through the dispenser tip 66 and selected applicator tip 69 (FIG. 4*d*) as first described above.

A paint dispensing and storage kit 100 according to still another embodiment of the present invention is shown in FIGS. 5*a* through 6*d* of the accompanying drawings and includes a construction substantially similar to the construction first described herein except as specifically noted below. The kit 100 according to this embodiment also includes a dispenser body 102 with dispenser tip 104 and a plunger 108. However, the plunger 108 and dispenser body 102 are uniquely configured to provide a storage reservoir.

More particularly, the plunger 108 includes a regulator valve 112 coupled to a distal end thereof relative to the plunger handle member 110. The regulator valve 112 includes first 114 and second 116 plates, the second plate 116 being coupled to the first plate 114 for longitudinal movement within the body chamber upon corresponding longitudinal movement of the plunger 108 but is not rotatable. The first plate 114 includes a diameter smaller than that of the second plate and is rotatably coupled to the second plate 116 (FIG. 5*c*) so as to be rotatable relative thereto upon rotation of the plunger 108 in general. The first 114 and second 116 plates define apertures 118, 120 such that the regulator valve 112 is movable between open and closed configurations upon respective rotation of the plunger 108.

The plunger 108 includes a sealing plate 122 intermediate the regulator valve 112 and the handle member 110. Therefore, a reservoir for containing excess paint for later use is defined between the regulator valve 112 and the sealing plate 122.

Figure 6A:
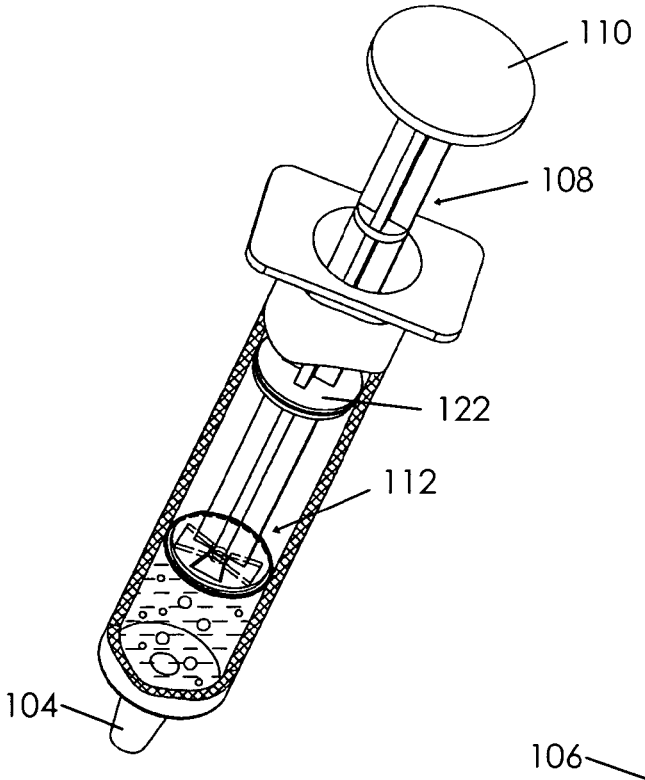
FIGS. 6*a*–6*d* illustrate operation of the kit as in FIG. 5*a.*
Figure 6B:
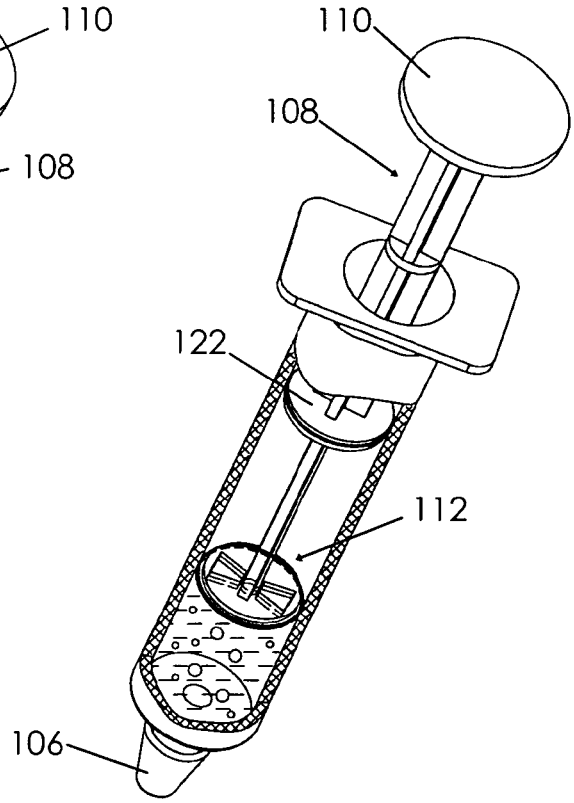
Figure 6C:
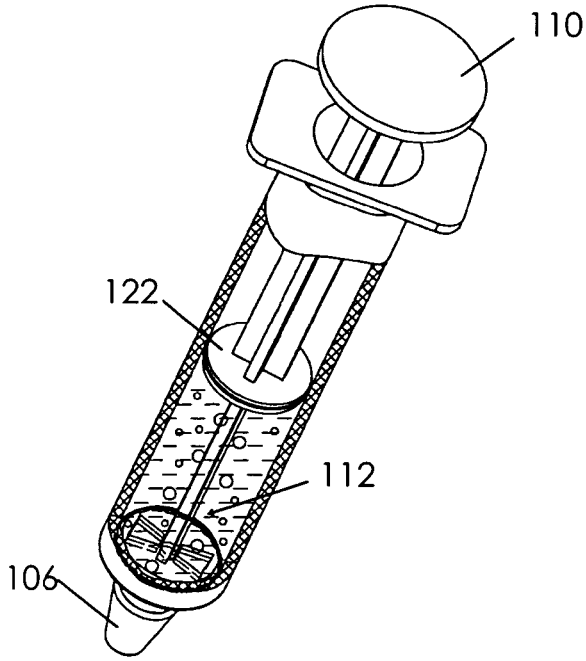
Figure 6D:
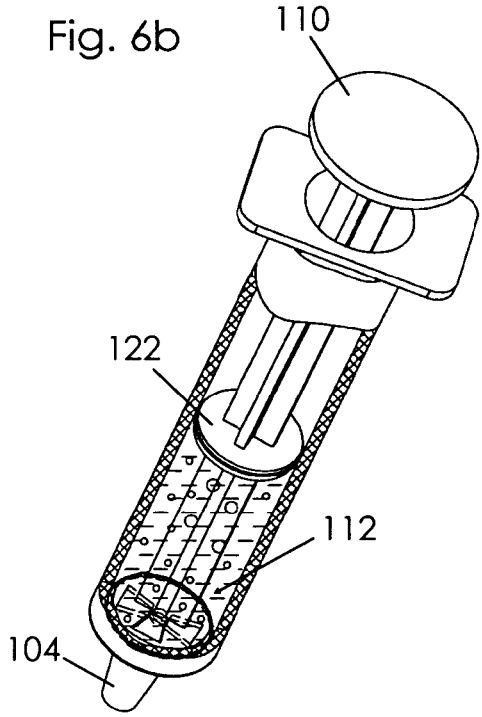

Operation of the kit 100 according to this embodiment is shown in FIGS. 6*a* through 6*d*. With the regulator valve 112 in a closed configuration and the dispenser tip 104 uncapped, an amount of paint may be drawn into the body chamber upon normal extension of the plunger 108 (FIG. 6*a*). Then, the plunger 108 may be rotated so as to align the apertures 118, 120 of the regulator valve 112 (FIG. 6*b*). With the cap 106 back in place, the plunger 108 may be moved to an inserted configuration, displacing the paint between the regulator valve 112 and sealing plate 122 (FIG. 6*c*). The plunger 108 may then be rotated in an opposite direction to close the regulator valve 112. At that configuration, the excess paint is sealed within the one piece reservoir. This procedure may be reversed to the FIG. 6*a* configuration, at which point the paint may be dispensed by urging the plunger 108 to the inserted configuration.

It is understood that while certain forms of this invention have been illustrated and described, it is not limited thereto except insofar as such limitations are included in the following claims and allowable functional equivalents thereof.

The invention claimed is:

1. A paint dispensing and storage kit, comprising:

a tubular paint dispensing body having a closed end and defining an open end opposite said closed end, said body defining a body chamber for holding a quantity of paint;

a plunger positioned in said body chamber for relative back and forth movement therein between extended and inserted configurations, said plunger having a handle member at a free end thereof that extends from said open end;

a dispenser tip operatively connected to said closed end of said body through which said quantity of paint may be dispensed from or drawn into said body chamber upon a respective movement of said plunger;

a cap for selectively removable attachment to said dispenser tip for preventing paint from being dispensed from or drawn into said body chamber;

a plurality of applicator tips for selectively removable attachment to said dispenser tip for applying dispensed paint to a surface; and a reservoir for storing paint;

wherein said reservoir is separate from said body chamber and includes:

a paint cartridge for storing paint therein and having a button valve at one end and an transfer valve at an opposed end;

a connector channel operatively connected to said dispenser tip of said body, said connector channel having a free end to which said transfer valve of said paint cartridge is removably coupled; and whereby paint stored in said paint cartridge is urged through said connector channel and into said body chamber when said transfer valve is connected to said connector channel and said button valve is actuated and said plunger is moved toward said extended configuration.

2. The paint dispensing and storage kit as in claim 1 wherein said reservoir is separate from said body chamber and defines an open top and an interior space, said reservoir including a funnel positioned in said interior space having a first end positioned proximate said open top and a second end positioned adjacent a bottom of said reservoir, said funnel first end having a configuration complementary to a configuration of said dispenser tip such that said funnel first end and said dispenser tip may be releasably connected together for a paint exchange between said reservoir and said body chamber.

3. The paint dispensing and storage kit as in claim 1 wherein said plurality of applicator tips include a brush applicator tip and a sponge applicator tip.

4. The paint dispensing and storage kit as in claim 1 wherein said cap and said plurality of applicator tips include threaded configurations complementary to a threaded portion of said dispenser tip for efficient removable attachment thereto.

5. The paint dispensing and storage kit as in claim 1 wherein said handle member includes a ring-top configuration.

6. The paint dispensing and storage kit as in claim 1 further comprising a cartridge base fixedly attached to said free end of said connector channel and having a configuration for releasably receiving said paint cartridge, said cartridge base having a stem for automatically opening said transfer valve when said paint cartridge is received by said cartridge base for a paint exchange between said paint cartridge and said body chamber.

7. The paint dispensing and storage kit as in claim 1 wherein:

said plurality of applicator tips include a brush applicator tip and a sponge applicator tip; and said cap and said plurality of applicator tips include threaded configurations complementary to a threaded portion of said dispenser tip for efficient removable attachment thereto.

8. The paint dispensing and storage kit as in claim 1 wherein said button valve and said transfer valve are spring-biased toward closed configurations.

9. The paint dispensing and storage kit as in claim 1 further comprising:

a shaft fixedly positioned in said paint cartridge having a first end coupled to said button valve with a spring for biasing said button valve toward a closed configuration and having a second end coupled to said transfer valve with a spring for biasing said transfer valve toward a closed configuration; and at least one agitator arm connected to said shaft for agitating paint within said paint cartridge.

10. The paint dispensing and storage kit as in claim 1 further comprising:

a regulator valve coupled to a distal end of said plunger relative to said handle member, said regulator valve being operable between open and closed configurations upon respective rotation of said plunger;

wherein said plunger includes a sealing plate intermediate said regulator valve and said handle member whereby said reservoir is defined between said regulator valve and said sealing plate;

whereby paint is permitted to flow into said reservoir when said cap is removed from said dispenser tip and said regulator valve is in said open configuration; and whereby paint is prevented from flowing out of said reservoir through said dispenser tip when said regulator valve is in said closed configuration or when said cap is attached to said dispenser tip.

11. A paint dispensing and storage kit, comprising:

a tubular paint dispensing body having a closed end and defining an open end opposite said closed end, said body defining a body chamber for holding a quantity of paint;

a plunger positioned in said body chamber for relative back and forth movement therein between extended and inserted configurations, said plunger having a handle member at a free end thereof that extends from said open end;

a dispenser tip operatively connected to said closed end of said body through which said quantity of paint may be dispensed from or drawn into said body chamber upon a respective movement of said plunger;

a cap for selectively removable attachment to said dispenser tip for preventing paint from being dispensed from or drawn into said body chamber;

a plurality of applicator tips for selectively removable attachment to said dispenser tip for applying dispensed paint to a surface;

a reservoir assembly including:

a paint cartridge for storing excess paint having a button valve at one end and a transfer valve at an opposed end;

a base having a configuration for removably receiving said opposed end of said paint cartridge, said base including a stem for automatically actuating said transfer valve when said paint cartridge is receiving by said base;

a connector channel operatively interconnecting said dispenser tip and said base;

whereby paint stored in said paint cartridge is urged through said connector channel and into said body chamber when said paint cartridge is received in said base and said button valve is depressed and said plunger is moved toward said extended configuration.

12. The paint dispensing and storage kit as in claim 11 wherein said plurality of applicator tips include a brush applicator tip and a sponge applicator tip.

13. The paint dispensing and storage kit as in claim 11 wherein said cap and said plurality of applicator tips include threaded configurations complementary to a threaded portion of said dispenser tip for efficient removable attachment thereto.

14. The paint dispensing and storage kit as in claim 11 wherein said handle member includes a ring-top configuration.

15. The paint dispensing and storage kit as in claim 11 wherein said button valve and said transfer valve are spring-biased toward closed configurations.

16. The paint dispensing and storage kit as in claim 11 further comprising:

a shaft fixedly positioned in said paint cartridge having a first end coupled to said button valve with a spring for biasing said button valve toward a closed configuration and having a second end coupled to said transfer valve with a spring for biasing said transfer valve toward a closed configuration; and at least one agitator arm connected to said shaft for agitating paint within said paint cartridge.

* * * * *